US006942127B2

(12) United States Patent
Raats

(10) Patent No.: US 6,942,127 B2
(45) Date of Patent: Sep. 13, 2005

(54) VALVE ASSEMBLY FOR USE IN DISPENSING BEVERAGE

(75) Inventor: Paul Henri Raats, Utrecht (NL)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 10/498,390

(22) PCT Filed: Dec. 12, 2002

(86) PCT No.: PCT/NL02/00823

§ 371 (c)(1),
(2), (4) Date: Oct. 14, 2004

(87) PCT Pub. No.: WO03/050031

PCT Pub. Date: Jun. 19, 2003

(65) Prior Publication Data

US 2005/0045662 A1 Mar. 3, 2005

(30) Foreign Application Priority Data

Dec. 13, 2001 (NL) ..... 1019562

(51) Int. Cl.[7] ..... B65D 83/00

(52) U.S. Cl. ..... 222/400.7; 222/399; 222/105; 141/346; 137/212; 137/322

(58) Field of Search ..... 222/400.7, 94, 222/400.8, 95, 396–397, 399, 509, 105, 325, 153.04; 137/614.04, 212, 322, 614.05; 251/149.6; 141/346–349, 2–4, 383, 386

(56) References Cited

U.S. PATENT DOCUMENTS 2,030,569 A * 2/1936 Brock ..... 215/12.1
3,776,260 A * 12/1973 Ruddick ..... 137/321
5,415,329 A * 5/1995 Westlund ..... 222/397
5,435,460 A * 7/1995 Osgar ..... 222/1
5,511,692 A * 4/1996 Willingham ..... 222/1
5,526,956 A * 6/1996 Osgar ..... 222/83
6,015,068 A * 1/2000 Osgar et al. ..... 222/400.7
6,325,100 B1 12/2001 Bunschoten et al.
6,367,667 B1 * 4/2002 Ipsen ..... 222/400.7
6,516,839 B1 2/2003 Timp et al.

FOREIGN PATENT DOCUMENTS

| | | |
|---|---|---|
| DE | 42 31 635 A | 3/1994 |
| FR | 2 138 685 A | 1/1973 |
| NL | 1 009 654 C | 1/2000 |
| WO | WO 00 03 944 | 1/2000 |

* cited by examiner

*Primary Examiner*—Frederick Nicolas
(74) *Attorney, Agent, or Firm*—Pearne & Gordon LLP

(57) ABSTRACT

A valve assembly for a container with an inner bag for receiving beverage, in particular carbonated beverage such as beer, wherein a beverage valve is provided with a communication with the inner space of the bag and a device for operation of the beverage valve by a tapping device in which the container is receivable, the beverage valve being partly surrounded by an upstanding first apron which is gas-tight, while, spaced therefrom, a second gas-tight apron is situated, and between the first and the second apron a bottom wall with at least one gas passage opening is provided which during use is in communication with the space enclosed between the inner bag and the container, such that during use between the two aprons a chamber is formed through which gas under pressure can be forced through the gas passage opening, separately from the beverage.

17 Claims, 5 Drawing Sheets

VALVE ASSEMBLY FOR USE IN DISPENSING BEVERAGE

This invention relates to a valve assembly for use in dispensing beverage. Such a valve assembly is known from NL 1009654.

This known valve assembly, which is intended in particular for use in beverage containers with an inner bag, such as bag-in-box, bag-in-container or bag-in-bag type containers, is provided with a valve body which functions at the same time as beverage valve and as gas valve. To that end, the valve body is of substantially cylindrical design, with on the inside a stem forming a beverage valve therewith, and on the outside a housing forming the gas valve therewith. The inner bag is secured against the stem on the lower-outer side thereof, so that beverage can only be displaced from the inner bag through the beverage valve, while gas can flow along the gas valve into a space between the inner bag and an outer container. To that end, the valve body is pressed downwards during use, against spring pressure. The valve body is biased into the closed position.

This known valve assembly has as a disadvantage that it is particularly complex in structure and is to be built together from a relatively large number of parts. Moreover, upon release of the valve body, the pressure built up between the inner bag and the outer container is maintained, also when, for instance, the inner bag has been emptied to a desired level and the container is to be discarded. This can lead to dangerous situations.

The object of the invention is to provide a valve assembly of the type described in the opening paragraph hereof, in which the disadvantages mentioned have been avoided while maintaining the advantages thereof.

More particularly, the object of the invention is to provide a valve assembly for containers with inner bag, permitting the container to be discarded directly, pressureless, after use.

A further object of the invention is to provide such a valve assembly which is relatively simple in structure.

A still further object of the invention is to provide such a valve assembly which offers the possibility of filling the inner bag relatively fast, through a relatively large opening, and of emptying it through a relatively small opening.

These and further objects can be achieved, individually or in combination, with a valve assembly according to the invention.

In a valve assembly according to the invention, use is made of a beverage valve which is simple in structure and use. This valve assembly does not necessarily comprise a gas valve. During use, there is an open communication between a gas supply channel and the inner space between the inner bag and the surrounding container, which container can be a relatively stiff container, an outer bag, a box or the like. Surprisingly, it has been found that such a valve assembly offers sufficient sealing for the inner bag and that upon removal of the container the beverage valve simply prevents, at least for a relatively long time, the volume of the inner bag enlarging upon removal of the pressure in the surrounding space. This means that, upon temporary change of that pressure, what can be prevented is contact of air in the inner bag with the beverage or the occurrence of an undesirable extent of separation of, for instance, carbon dioxide from the beverage.

In a valve assembly according to the invention, preferably use is made of gas- and liquid-tight aprons, at least sealing thereagainst, so that a chamber is formed, screened from the beverage valve, into which gas can be supplied under pressure so as to be passed into the space between the inner bag and the container. The position of an inlet for gas into said chamber can then be chosen at random, in particular also asymmetrically with respect to the beverage valve, that is, in top plan view next to it, which further simplifies connection.

An additional advantage of a valve assembly according to the invention is that pressurizing the inner bag by introducing gas and opening the beverage valve can be done separately in time. Thus, for instance, gas can be supplied before the beverage valve is opened. Thus, for a longer time, an air-tight sealing of the inner bag and hence of the beverage is maintained, which is beneficial to the quality of the beverage. In particular in the case of carbonated and/or oxidizing beverages, at least liquids such as beer and the like, this is particularly advantageous. Moreover, filling the inner bag is possible in a simpler manner, since the pressures in and around the inner bag are simply controllable independently of each other.

The valve body of the beverage valve is preferably so dimensioned that it has a frontal surface that is greater than the cross section of the opening through which the beverage is dispensed, such that the valve body can be placed from the underside, that is, the side remote from the aprons, and can be pressed against the valve seat formed around said opening by, for instance, a spring. Thus, a valve biased into the closed position is readily obtained, which valve, moreover, is easy to assemble. The valve body can, for instance, be locked simply by a dip tube or the like.

In a valve assembly according to the invention, preferably, around the second apron, a third apron is provided which on the outer side is provided with first coupling means for cooperation with complementary means in the container, while second coupling means are provided for coupling with the connecting element. The first coupling means are preferably screw thread, part of a bayonet catch or the like. In such an embodiment, the valve assembly can be simply secured in the container, for instance in a neck thereof, while the connecting element can also be simply fitted. In particular, the valve assembly can be fitted prior to the filling of the container, the connecting element afterwards. Along with the connecting element, a dispensing element can then be fitted as well.

The invention further relates to an assembly of a valve assembly according to the invention and a connecting element for coupling therewith, characterized by the features according to claim 9.

Such an assembly offers the advantage that a container can be built up particularly simply, in particular a bag-in-container type, allowing the valve assembly to be fitted, preferably together with the inner bag, and the inner bag can be simply filled, after which the connecting element can be fitted in which a dispensing element is included. The connecting element, in particular the dispensing element, then offers, in coupled condition, the possibility of operating the beverage valve, while the chamber referred to is formed upon placement of the connecting element. The connecting element abuts at least liquid-tightly against the apron, in particular against the inside thereof, and preferably by way of a slightly flexible edge. Thus, readily, a movable seal between dispensing element and apron is obtained. The passage channel of the dispensing element can then be simply made of relatively thin design, so that beverage will be dispensed with a smaller flow rate, at least through a smaller opening than the opening by which the inner bag is filled. Thus, a particularly advantageous tapping behavior can be simply obtained.

The invention further relates to a container provided with an inner bag for receiving beverage, in particular carbonated beverage, such as beer, characterized by the features according to claim 15.

Such a container is suitable in particular for use with a valve assembly according to the invention or in an assembly according to the invention.

The invention additionally relates to a method for use of a container with an assembly according to the invention, characterized by the features according to claim 16.

Such a method provides the advantage that the inner bag can be filled relatively fast and simply, along the beverage valve, while the back pressure in the space between the inner bag and the surrounding container can be simply controlled, while the connecting element can thereupon be readily placed for rendering the container suitable for use in a tapping device.

Further advantageous embodiments of a valve assembly, a container assembly and a method according to the invention are further elucidated hereinbelow with reference to the drawing. In the drawing:

FIG. 1 shows in sectional side elevation a valve assembly according to the invention, with inner bag partially drawn in;

In this description, the same or corresponding parts have the same or corresponding reference numerals.

In this description, exemplary embodiments will be described for use with carbonated beverage, in particular beer.

It will be clear, however, that such an assembly can also be used for other fluids. In the exemplary embodiments shown, a container is shown in the form of a bag-in-container type, that is, with a relatively stiff outer container and a flexible inner bag. It will be clear, however, that 'container' in this application should be understood to also include at the least a bag-in-box or a bag-in-bag. An assembly according to the invention can be used, for instance, in a tapping device as described in the non-prepublished patent application NL 1019054. However, such an assembly can also be used in other tapping devices, as long as the latter is provided with suitable connecting means for a gas under pressure and for the dispensing hose for the beverage.

Figure 1:
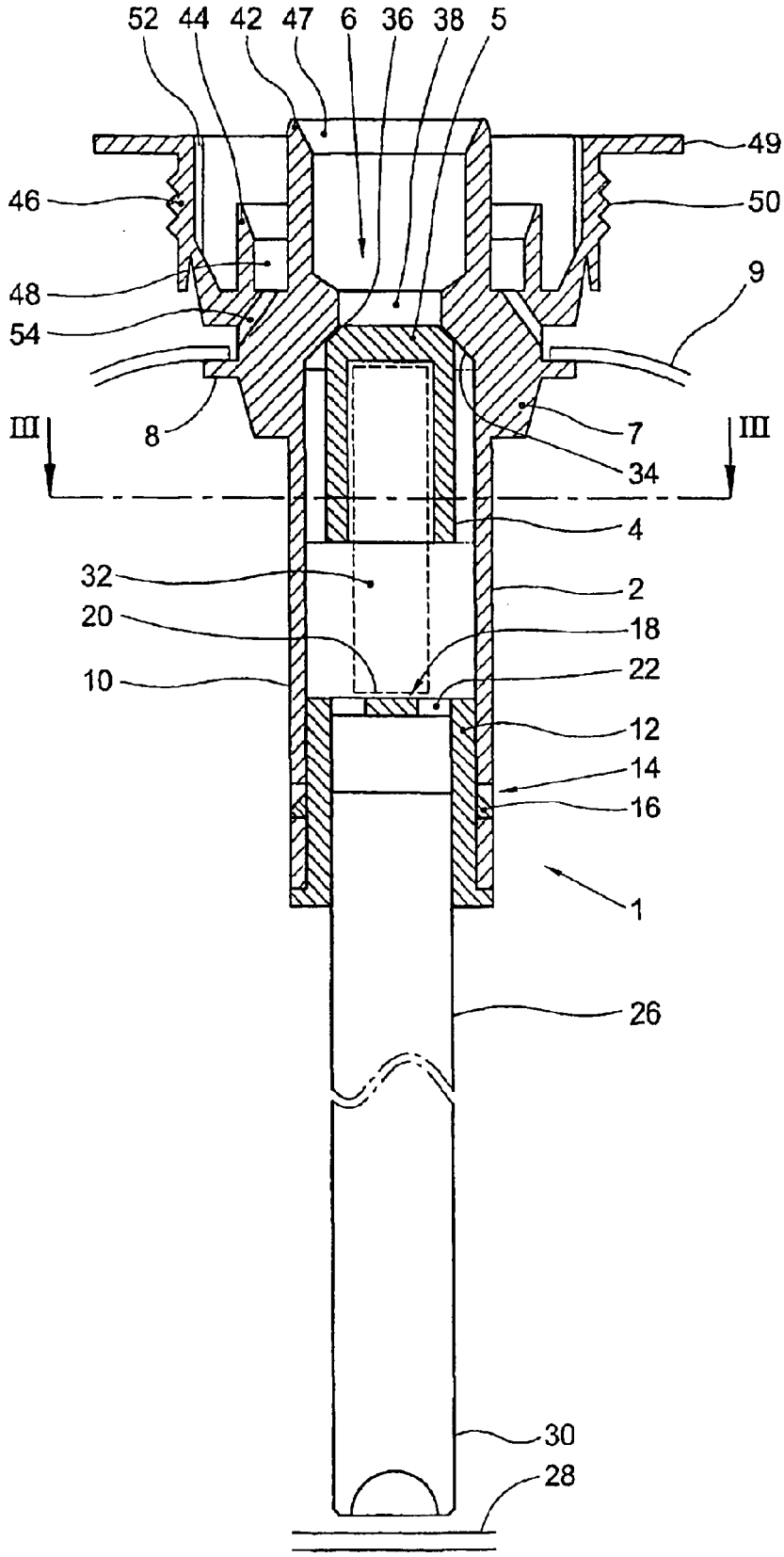

A valve assembly according to FIG. 1 comprises a housing 2 of a substantially cylindrical shape, in which a hollow-cylindrical valve body 4 is received, provided with an end wall 5. The end wall 5 constitutes a closing face of a beverage valve 6. The housing 2 comprises a collar 7 on which a flange 8 is provided, on which flange 8 the inner bag 9 of the bag-in-container (further to be called: container) is secured. From the underside in FIG. 1 of the collar 7 extends a first tubular part 10 in which the valve body 4 is received. From the side remote from the collar 7, a closing body 12 has been secured in the tubular part 10, with projections 16 extending into recesses 14, which closing body 12 is provided, on the side facing the valve body 4, with a supporting element 18, provided with a central part 20 and a number of spokes 22, between which passage openings 24 are provided. A riser (dip tube) 26 has been inserted into the closing body 12 and during use extends to a point close to the bottom 28 of the inner bag 9. The underside of the dip tube 26 is provided with gate-shaped openings 30, so that it cannot be closed off by the inner bag 28. Resting on the supporting element 18, at least the spokes 22, is a spring 32, schematically represented by a rectangle represented in broken lines, which extends in the valve body 4, and biases the valve body 4 against a valve seat 34, formed in the collar 7, which is inclined and cooperates with an inclined part 36 of the closing face 5. In the collar 7, a passage opening 38 is provided which is smaller than the frontal surface of the valve body 4.

The valve body 4 is provided around its outer circumference with a number of radially extending ribs 40, which guide the valve body 4 against the inside of the first tubular part 10 and moreover leave space clear between the inner side of the tubular part 10 and the valve body 4, so that, with the beverage valve 6 open, whereby space has been created between the closing face 5 and the valve seat 34, beverage can flow from the dip tube 26 along the valve body 4 through the passage opening 38. In the exemplary embodiment shown, four ribs 40 are provided, extending parallel to the longitudinal direction of the tubular part 10.

Provided on the side of the collar 7 remote from the first tubular part 10 are a first apron 42, a second apron 44 and a third apron 46. These aprons 42, 44, 46 extend concentrically with respect to each other and with respect to the passage opening 38 and the valve body 4. The first apron 42 surrounds the opening 38 at a relatively small distance and is relatively high, at least higher than the second and third aprons 44, 46. The longitudinal edge 47 remote from the collar 7 is inclined inwardly in the direction of the opening 38 and outwardly in the direction of the second apron 44.

The second apron 44 is relatively low, at least lower than the third apron 46, and surrounds the first apron 42 at a distance. Provided between the first and second apron 42, 44 is a bottom wall 48. The third apron 46 is provided, along the upper edge thereof, with an outwardly reaching flange 49 and is moreover provided with screw thread 50 on the outer side. Provided on the inner side of the third apron 46 are engagement ribs 52 for tools with which the valve assembly 1 can be screwed into or screwed out of the neck of a container. It will be clear that for that purpose also other means can be provided.

Figure 2:
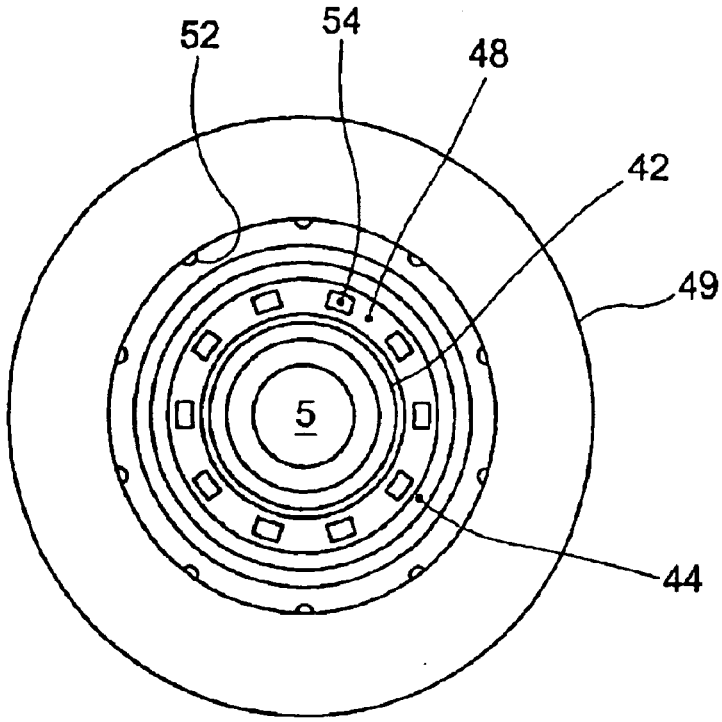
FIG. 2 shows the tapping valve assembly in top plan view.
Figure 3:
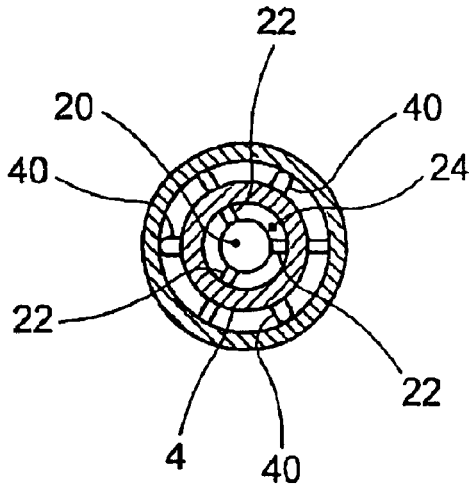
FIG. 3 shows the tapping valve assembly in sectional side elevation along the line III—III in FIG. 1.

From the bottom wall 48, openings 54 extend through the collar 7, terminating above the flange 8, at least above the inner bag 9. In the top plan view according to FIG. 2, nine such passages are provided, but it will be clear that any desired number of passages can be used, also, for instance, just one.

In FIG. 1 the valve assembly 1 is shown in closed condition. From this closed condition, the beverage valve 6 can be opened by pressing the valve body 4 down against the spring pressure of the spring 32, away from the passage opening 38, so that beverage can pass the valve body 4. During the filling of the inner bag 9, the valve body 4 can be pressed away relatively far from the valve seat 34 for obtaining a large passage. During the dispensing of beverage, the valve body 4 needs to be pressed down only a little. To that end, a relatively small force can suffice.

Figure 4:
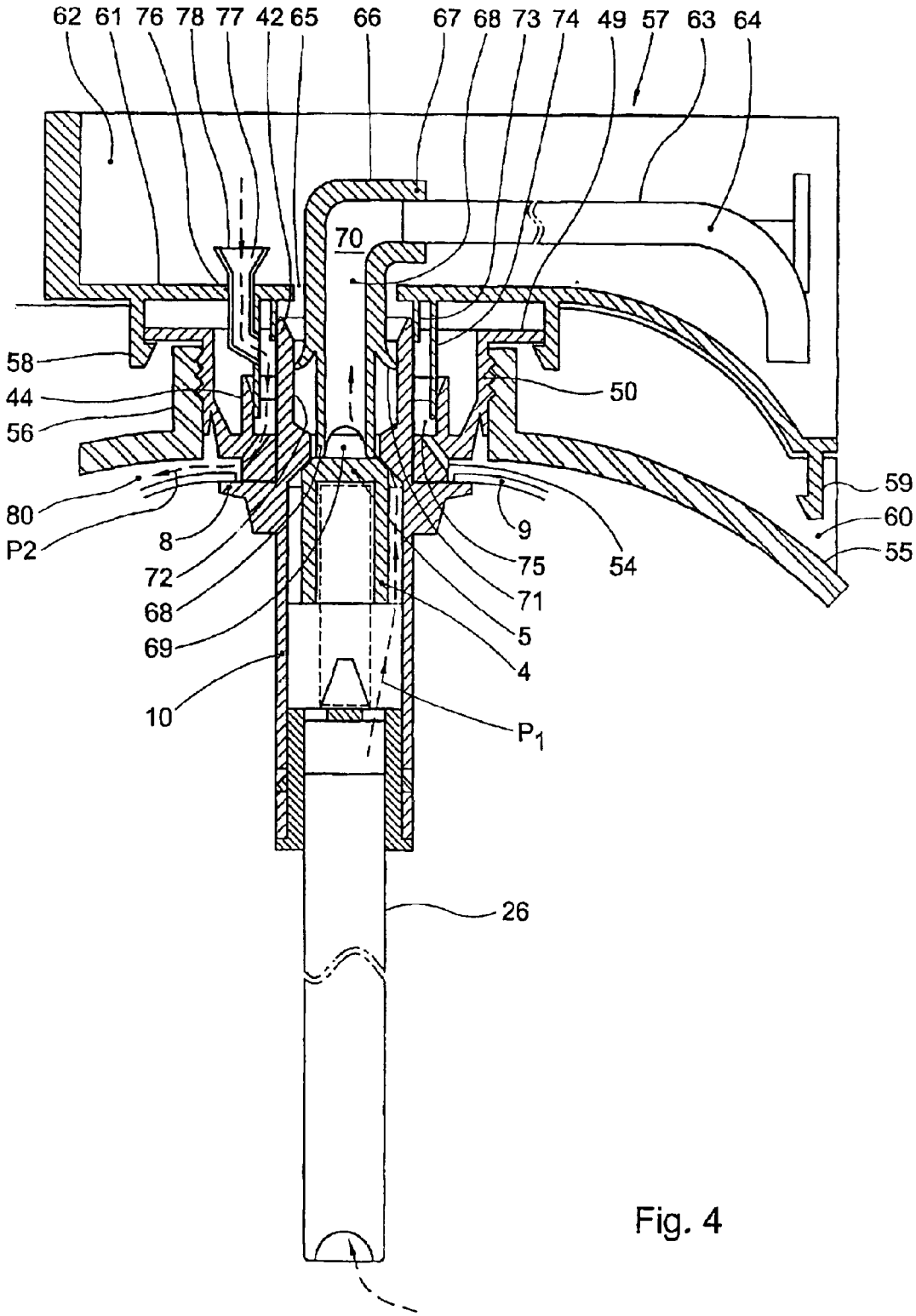
FIG. 4 shows a tapping valve assembly according to the invention secured in a container, with an associated connecting element.

FIG. 4 shows in partial cross-sectional side elevation a valve assembly 1 according to FIG. 1, included in a container 55, for instance manufactured from plastic or metal. The valve assembly has been screwed by the outer thread 50 into matching thread in a neck 56 of the container 55, such that the flange 49 reaches outside the neck 56. A connecting element 57 has been secured by way of snap fingers 58 or like clamping means onto the flange 49. Optionally, further snap means 59 may be provided for further securing the connecting element 57 onto the container 55, in particular on a collar 60 mounted thereon.

The connecting element 57 comprises a bottom 61 and an upstanding longitudinal wall 62 in which a dispensing hose 63 having a knee-shaped tapping part 64 can be locked. The hose 63 is preferably substantially flexible and of a length such that the element 64 can be displaced outside the connecting element 57, for instance for cooperation with a cock of a suitable tapping device.

In the bottom 61, a first opening 65 is provided, through which extends a dispensing element 66 which is substantially knee-shaped, the hose 63 being secured in a first leg 67 thereof. The second leg 68 extends approximately vertically and is provided at its free end with a number of legs 68 with passage openings 69 between them, such that when the legs 68 rest on the closing face 5 of the valve body 4, and the valve body 4 with the dispensing element 66 has been slightly moved down from the position depicted in FIG. 4, beverage can flow via the dispensing tube 26 along the valve body 4 through the openings 69 into the channel 70 of the dispensing element 66, as represented by dotted arrows $P_1$ in FIG. 4. From the channel 70, the beverage can then be dispensed via the hose 63 and the element 64.

The dispensing element 66 is provided, on the second leg 68 thereof, with an outwardly extending flexible collar 71 downwardly inclined to some extent, which, under minor elastic deformation, abuts against the inner side 72 of the first apron 42. As a result, a gas- and liquid-tight sealing is obtained between the second leg 68 and the first apron 42. This collar 71, at least sealing, can naturally be obtained in a different way as well, for instance by an O-ring.

The bottom 61 is provided, around the first opening 65, with a downwardly reaching first collar 73, which, during use, abuts against the outer side of the first apron 42, while a second collar 74 is provided, which abuts against the inner side of the second apron 44. Thus, a gas-tight chamber 75 has been obtained between the first apron 42, the second apron 44, the first collar 73, the second collar 74, and the bottom wall 48 and the bottom 61, respectively, which chamber 75 is in open communication with the passage channels 54. In the bottom 61, next to the first opening 65, a second opening 76 is provided, through which extends a funnel-shaped gas channel 77 which terminates at the underside in the chamber 75. During use, to the funnel-shaped part 78 of the gas channel 77, a gas supply line can be connected, such that gas under pressure can be introduced via the funnel-shaped gas channel 77, the chamber 75 and the passage channels 54 between the container 55 and the inner bag 9, as schematically represented by the dotted arrows $P_2$ in FIG. 4. Preferably, the funnel-shaped part 78 is of flexible design, so that a simple connection can be obtained.

An assembly according to the invention can be used as follows.

The inner bag 9 is wrapped around the tubular part 10 and the dip tube 26, after which the valve assembly, with the inner bag forwards, is screwed into the neck 56 of the container 55, to the extent where the flange 49 approximately abuts against the neck 56. Subsequently, with a filling head (not shown) suitable therefor, beverage is introduced along the beverage valve 4 into the inner bag 9, thereby displacing the inner bag outwards, whereby air can escape through the passage channels 54. The valve body 4 can be pressed away by the filling head, but may also be pressed away as a result of the liquid pressure, against the spring pressure. If the pressure on the valve body 4 is removed, for instance when the inner bag 9 is full, it will close automatically. Next, the connecting element 57 is pressed by way of the snap fingers 58 thereof over the flange 49, such that the desired sealing is obtained between the two aprons 42, 44 and the collars 73, 74. The container is then ready for use.

Prior to use, a container is placed in a suitable tapping device, the element 64 is laid in a cock, or connected therewith, and a gas supply line is connected to the gas channel 77, after which the dispensing element 66 is pressed down for dispensing beverage. Through pressure build-up in the space 80 between the inner bag 9 and the container 55, the inner bag 9 is pressurized inwards, so that, with the beverage valve 4 open, beverage is forced via the dip tube 26 along the beverage valve 4, through the hose 63, so that it can be dispensed. Possibly, for that purpose the cock of the tapping device should be opened.

In the exemplary embodiment shown, the first apron 42 is relatively high and the second apron is relatively low, so that placement of the connecting element is enabled relatively simply. Moreover, this yields a relatively great length over which a moving seal can be obtained with respect to the edge 71. This means a relatively large stroke for the dispensing element 66.

Figure 5:
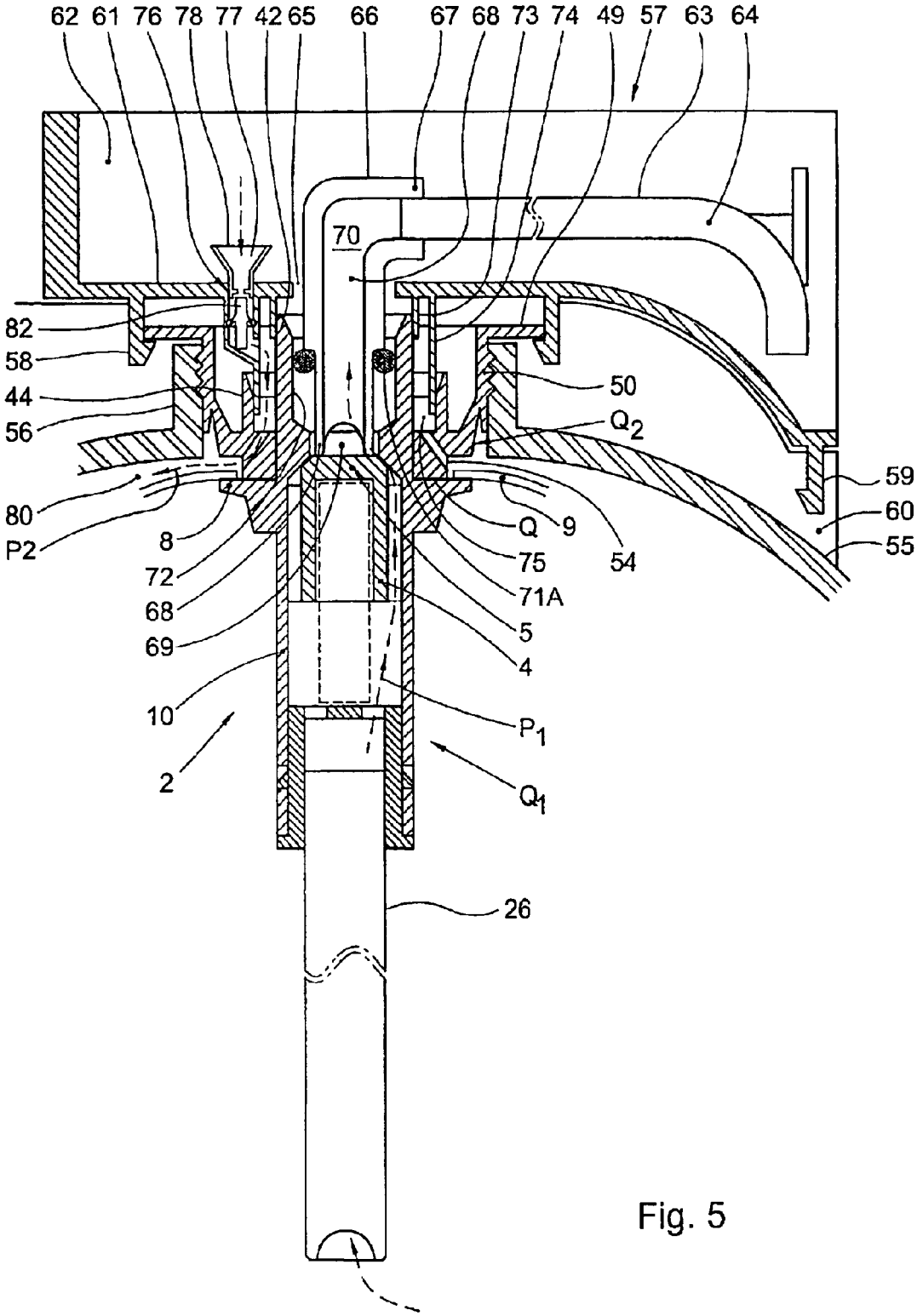
FIG. 5 shows in sectional side elevation an alternative embodiment of a valve assembly according to the invention, secured in a container.

FIG. 5 shows an alternative embodiment of a valve assembly 1 according to the invention, placed in a container 55. This figure is comparable to FIG. 4. The same parts have the same reference numerals. FIG. 5 will be discussed here only insofar as it differs from the embodiment according to FIG. 4.

In this embodiment, the flexible collar 71 as shown in FIG. 4 has been replaced with an O-ring 71A, for instance a rubber O-ring or the like, yielding a sealing against the apron 42. In this embodiment, the housing 2 is divided into two parts along the dividing line Q. As a result, the valve housing 2 comprises a substantially cylindrical part $Q_1$ comprising the tubular part 10, the collar 7 and the inner apron 42 with the valve seat 34. The second, upper part $Q_2$ comprises the channel-shaped openings 54 and the two outer aprons 44, 46 as well as the flange 49. The two parts $Q_1$, $Q_2$ have been secured onto each other so as to form a gas-tight closure, for instance through gluing, welding or the like, in particular spin welding.

Figure 8:
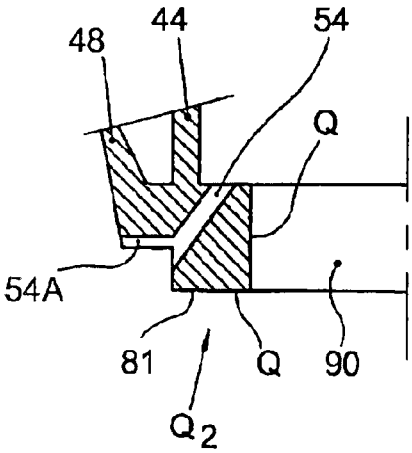
FIG. 8 shows a detail of a valve housing part with opening.

FIG. 8 schematically shows a portion of the upper part $Q_2$ of the housing 2, enlarged to some extent, loose from the lower part $Q_1$. Clearly visible is the opening 90 through which the first apron 42 can be fittingly inserted, such that the underside 81 can rest on the upper side of the flange 7. Shown is a single passage 54 through which gas can flow during use, which passage 54 comprises a horizontal part 54A. This yields the advantage that at all times a situation is prevented where the or each passage 54 can be closed off by the bag 9. It will be clear that forming the housing 2 in two parts $Q_1$, $Q_2$ is advantageous from a manufacturing viewpoint.

In the embodiment shown in FIG. 5, the flange 8 tapers slightly in outward direction, which is advantageous from a thermal viewpoint when securing the bag 9 thereon, for instance by heat-sealing, heat-bonding or the like.

Figure 7:
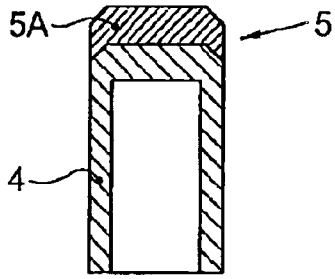
FIG. 7 shows a valve body, 2K-injection molded.

FIG. 7 shows a valve body 4, which is provided at the top 5 with a relatively soft covering 5A, for instance a soft plastic or rubber. Preferably, this valve body 4 has been manufactured by two-component injection molding (2K-injection molding). The relatively soft covering 5A will provide for a proper sealing against the valve seat 36.

Figure 6:
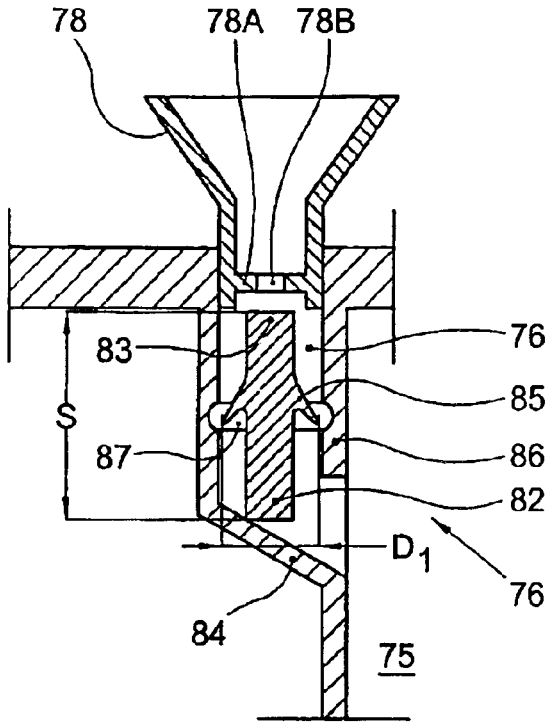
FIG. 6 shows, enlarged, a gas valve for a valve assembly according to the invention.

FIG. 5 shows an alternative embodiment of the second opening 76, in which, in this embodiment, a valve body 82 is received. In FIG. 6, the second opening 76 with the valve body 82 therein is represented slightly enlarged. In this embodiment, the funnel-shaped part 78 has been fitted in the opening 76 as an insert, thereby confining the valve body 82. The funnel-shaped body 78 comprises a bottom wall 78A with central opening 78B, which opening is smaller than the proximal end 83 of the valve body 82. The axial length S of the valve body 82 has been selected such that it can move slightly between the bottom wall 78B and an opposite end wall 84 of the opening 76, in axial direction. The valve body 82 is made of relatively thin design, and is provided with an inclined outwardly reaching apron 85, which is slightly frustoconical, the wider part thereof facing away from the bottom wall 78A. In the wall 86, which surrounds the opening 76, on the inner side a circumferential groove 87 is provided, adjacent the free longitudinal edge of the apron 85 when the valve body 82 is in the lower position, as shown in FIG. 6. The diameter $D_1$ of the apron 85 is slightly greater than the inner diameter of the wall 86, but slightly smaller than the maximum diameter of the groove 87. Therefore, when the valve body 82 is moved up, until the end 83 is against the bottom wall 78A, then the apron 85 will be in sealing engagement with the inner side of the wall 86, so that no gas can flow back from the space 80, at least the chamber 75, along the valve body 82, the less so since the valve body 82 will then substantially close off the opening 78B. The use of such a valve body 82 can offer the advantage that upon removal of the container 55 from a dispensing device the valve body 82 will close, thereby preventing gas from flowing out of the space 80 and hence the pressure in the space from diminishing considerably. Thus the quality of the beverage in the bag 9 is preserved still better.

In the embodiment shown in FIG. 5, the bag 9 could be received, by way of the edge thereof, between the two parts $Q_1$, $Q_2$, which can result in a better sealing. In the embodiment shown, however, the bag 9 has been secured onto the flange 8, outside the second part $Q_2$. In this way too, a proper sealing can be obtained and preserved.

It will be clear that combinations of parts of the different embodiments shown are also understood to have been represented herein and hence fall within the concept of the invention.

The invention is not limited in any way to the exemplary embodiments shown in the description and the drawing. Many variations thereon are possible within the scope of the invention outlined by the claims. Thus, for instance, the passage channels can be provided at different positions, the valve assembly can be built together from several parts, the valve body can be biased and be designed in different ways, and the aprons can be arranged in a different manner than concentrically. This last can be advantageous, for instance, when a specific orientation is desired. In the embodiment shown, no orientation direction of the valve assembly relative to the connecting element has been obtained, which further simplifies placement. The connecting element can of course have a variety of forms and be constructed in any desired material. In an advantageous embodiment of the valve assembly, the second and third apron are included in a first housing part with a central opening via which this first housing part has been secured over the first apron onto the collar 7, for instance by spin-welding, pressure-welding, gluing or the like.

These and many comparable variations are understood to fall within the scope of the invention outlined by the claims.

What is claimed is:

1. A valve assembly for a container in which an inner bag is provided for receiving beverage, in particular carbonated beverage, wherein a beverage valve is provided which on a side facing the inner bag is provided with a communication with an inner space of the bag and on the opposite side from said side facing the inner bag is provided with means for operation of the beverage valve by a tapping device in which the container is receivable, wherein the beverage valve, on the opposite side, is surrounded by an upstanding first apron which is gas-tight, while along an outer side of said first apron, at a distance therefrom, a second apron is situated, also gas-tight, while between the first and the second apron a bottom wall with at least one gas passage opening is provided which during use is in communication with a space enclosed between the inner bag and the container surrounding the inner bag, the arrangement being such that during use a collar of a connecting element abuts gas-tightly and liquid-tightly against the second apron, while a dispensing element abuts gas-tightly and liquid-tightly against the first apron, so that between the two aprons a chamber is formed through which during at least part of said use gas under pressure is forced through said at least one gas passage opening, separately from the beverage.

2. A valve assembly according to claim 1, wherein the first apron is higher than the second apron.

3. A valve assembly according to claim 1, wherein the first and the second apron are arranged concentrically with respect to the beverage valve.

4. A valve assembly according to claim 1, wherein the beverage valve comprises a valve body having a frontal surface, facing the first apron, that is greater than the cross-sectional surface of the channel enclosed by the first apron, and wherein the end of the first apron facing the valve body defines a valve seat for the valve body.

5. A valve assembly according to claim 1, wherein the beverage valve comprises a valve body which is biased in the direction of a valve seat defined adjacent the lower end of the first apron in a tubular body surrounding the valve body and connecting to said first apron, at least to the bottom wall, wherein the valve body comprises spacer means for forming passage openings between the valve body and said tubular body, at least with the beverage valve open.

6. A valve assembly according to claim 5, wherein said valve body is biased by spring means which are supported on a closing element which has been fitted from the end situated opposite the first apron into the tubular body and has been secured therein.

7. A valve assembly according to claim 6, wherein the closing element has been secured by resilient projections engaging in the passage openings.

8. A valve assembly according to claim 1, wherein around the second apron, on the side remote from the first apron, a third apron is provided which, on the outer side thereof, is provided with first coupling means for cooperation with complementary means in the container, in particular screw thread or bayonet means and with second coupling means for coupling to the connecting element.

9. An assembly of a valve assembly according to claim 1 and a connecting element for coupling thereto, wherein the connecting element is provided, on a first side thereof, with the collar which in a condition of use abuts gas-tightly and liquid-tightly against the second apron, while within the collar the dispensing element is situated which extends as far as the second side of the connecting element and is movable in the direction of the beverage valve, relative to the collar, which said dispensing element is substantially hollow and on the second side links up with a dispensing hose or tube and on the first side is provided with a connecting edge which can cooperate gas-tightly and liquid-tightly with the first apron, while a gas channel extends from the second side of the connecting element, reaching into the chamber enclosed during use between the first apron, the second apron, the bottom wall, and the connecting element, such that via the gas channel the gas under pressure can be forced through the at least one gas passage opening, while by pressing the dispensing element down against the beverage valve, the beverage valve can be opened for dispensing beverage, through the dispensing element and the dispensing hose or tube.

10. An assembly according to claim 9, wherein the gas channel, on the second side, terminates next to a passage opening through which the dispensing element extends.

11. An assembly according to claim 9, wherein the dispensing element on the first side is provided with a slightly flexible edge which abuts sealingly against the inner side of the first apron, which edge preferably reaches outwardly to some extent.

12. An assembly according to claim 9, wherein the connecting element comprises, within the collar, a second collar, around the dispensing element, which second collar sealingly engages the upper longitudinal edge and/or the outer side of the first apron.

13. An assembly according to claim 9, wherein the connecting element comprises a chamber in which the dispensing hose or tube is receivable.

14. An assembly according to claim 9, wherein the connecting element is provided with counter-coupling means for coupling with second coupling means provided on a third apron of the valve assembly, for securing the connecting element on the valve assembly.

15. The valve assembly according to claim 1 in combination with said container in which said inner bag is provided for receiving beverage, in particular carbonated beverage.

16. A method for using the assembly in combination with the container according to claim 15, provided with the assembly according to claim 9, wherein in a neck of the container the valve assembly is secured, with the inner bag secured to the valve assembly, after which the inner bag is filled through the valve assembly along the beverage valve, with connecting element removed, whereafter subsequently the connecting element is secured on the valve assembly and/or the container, with the beverage valve closed.

17. A method according to claim 16, wherein after fitting the connecting element, the container is placed in a tapping device and subsequently a gas is introduced through the at least one gas passage opening between the inner bag and the surrounding container for compressing the inner bag, thereby displacing the beverage present in the inner bag, upon opening of the beverage valve.

* * * * *